US006195835B1

(12) United States Patent
Song et al.

(10) Patent No.: US 6,195,835 B1
(45) Date of Patent: Mar. 6, 2001

(54) VACUUM CLEANER HAVING A CYCLONE DUST COLLECTING DEVICE

(75) Inventors: Jeong-gon Song; Se-wook Kim; Hyun-eung Kim; Jin-seul Joung, all of Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/388,532

(22) Filed: Sep. 2, 1999

(30) Foreign Application Priority Data

| | | |
|---|---|---|
| Dec. 2, 1998 | (KR) | 98-52460 |
| Dec. 4, 1998 | (KR) | 98-53192 |
| Dec. 4, 1998 | (KR) | 98-53196 |
| Dec. 4, 1998 | (KR) | 98-53197 |
| Dec. 11, 1998 | (KR) | 98-54508 |
| Jun. 4, 1999 | (KR) | 99-20704 |

(51) Int. Cl.[7] ..... A47L 9/16

(52) U.S. Cl. ..... 15/327.1; 15/352; 15/353; 15/350; 55/459.1; 55/DIG. 3

(58) Field of Search ..... 15/327.1, 352, 15/353, 350; 55/459.1, DIG. 3

(56) References Cited

U.S. PATENT DOCUMENTS

| | | | | |
|---|---|---|---|---|
| 2,617,138 | * | 11/1952 | Brown, Sr. et al. | 15/353 |
| 2,763,886 | * | 9/1956 | Brown, Jr. et al. | 15/353 |
| 3,267,511 | * | 8/1966 | Meyerhoefer | 15/353 |
| 4,833,753 | * | 5/1989 | Muller | 15/352 |
| 4,853,008 | * | 8/1989 | Dyson | 15/353 |
| 5,145,499 | * | 9/1992 | Dyson | 15/352 |
| 5,307,538 | * | 5/1994 | Rench et al. | 15/352 |
| 5,350,432 | | 9/1994 | Lee | 55/408 |
| 5,735,403 | * | 4/1998 | Stiglianese | 55/459.1 |
| 5,950,274 | * | 9/1999 | Kilstrom | 15/353 |

FOREIGN PATENT DOCUMENTS

| | | |
|---|---|---|
| 0 827 710 | 3/1998 | (EP) . |
| 56-54056 | 10/1979 | (JP) . |
| 5-168574 | 7/1993 | (JP) . |
| 2583345 | 12/1993 | (JP) . |
| 8-322769 | 12/1996 | (JP) . |
| 10-85159 | 3/1998 | (JP) . |
| 11-56718 | 3/1999 | (JP) . |
| 93/4891 | 3/1993 | (KR) . |
| 93/5099 | 3/1993 | (KR) . |

* cited by examiner

*Primary Examiner*—Robert J. Warden, Sr.
*Assistant Examiner*—Theresa T. Snider
(74) *Attorney, Agent, or Firm*—Robert E. Bushnell, Esq.

(57) ABSTRACT

A vacuum cleaner having a cyclone dust collecting device for separating and collecting dust and dirt of a comparatively large particle size sucked from a suction opening of the cleaner by centrifugal force. The cyclone dust collecting device is biaxially placed against the extension pipe of the cleaner and includes a cyclone body having first and second connecting tubes connected to the extension pipe and a dirt collecting tub connected to the cyclone body to be removable. The cyclone body has an air inlet communicating with the first connecting tube and an air outlet communicating with the second connecting tube. The dirt-containing air sucked via the suction opening enters via the air inlet in a slanting direction against the cyclone body, thereby producing a whirlpool air current inside of the cyclone body. The dirt contained in the air is separated from the air by centrifugal force and is collected at the dirt collecting tub. A dirt separating grill having a plurality of holes is formed at the air outlet of the cyclone body to prevent the dust from flowing backward via the air outlet together with the air. Thereby, the dirt sucked together with the suction air is primarily collected by the cyclone dust connecting device, thus extending the period of time before replacing the paper filter. Further, it is possible to remove the collected dirt without completely separating the cyclone dust collecting device from the extension pipe.

22 Claims, 12 Drawing Sheets

3"
3"b
12b
12
22
22b
40
30
43b
43c
42a
42
42b
51
52
50a
20
53
50
60
21a
43a
43
44
21
21b
41
11
29
29
11b
32a
31c
31b
31
31a
3'
3'b
32

VACUUM CLEANER HAVING A CYCLONE DUST COLLECTING DEVICE

CLAIM OF PRIORITY

This application makes reference to, incorporates the same herein, and claims all benefits accruing under 35 U.S.C. §119 from an application for *VACUUM CLEANER HAVING CYCLONE DUST-COLLECTING APPARATUS* earlier filed in the Korean Industrial Property Office on Dec. 2, 1998 and there duly assigned Ser. No. 52460/1998, an application for *CYCLONE COLLECTING APPARATUS FOR USE IN VACUUM CLEANER* earlier filed in the Korean Industrial Property Office on Dec. 4, 1998 and there duly assigned Ser. No. 53192/1998, an application for *CYCLONE COLLECTING APPARATUS FOR USE IN VACUUM CLEANER* earlier filed in the Korean Industrial Property Office on Dec. 4, 1998 and there duly assigned Ser. No. 53196/1998, an application for *CYCLONE COLLECTING APPARATUS FOR USE IN VACUUM CLEANER* earlier filed in the Korean Industrial Property Office on Dec. 4, 1998 and there duly assigned Ser. No. 53197/1998, an application for *CYCLONE COLLECTING APPARATUS FOR USE IN VACUUM CLEANER* earlier filed in the Korean Industrial Property Office on Dec. 11, 1998 and there duly assigned Ser. No. 54508/1998, and an application for *VACUUM CLEANER HAVING CYCLONE DUST-COLLECTING APPARATUS* earlier filed in the Korean Industrial Property Office on Jun. 4, 1999 and there duly assigned Ser. No. 20704/1999.

BACKGROUND OF THE INVENTION

1. Field of the Invention

The present invention relates to a vacuum cleaner, and more particularly to a vacuum cleaner having a cyclone dust collecting device which primarily catches and collects dirt or dust as well as toilet paper, vinyl, and hair.

2. Description of the Related Art

A general vacuum cleaner, as shown in FIG. 1, has a main body 1 of the cleaner, a connection hose 2 connected to the main body 1, a plurality of extension pipes 3 connected to the connection hose 2 and a suction opening 4 connected to the end of the extension pipe 3. A cover 5 is mounted on the main body 1 to be able to be opened and closed and the connection hose 2 is connected to the cover 5. A dust collecting chamber 6 is disposed inside of the main body 1 and a paper filter 7 which collects dirt or dust is placed to be removable in the dust collecting chamber 6. A reference numeral 8 represents a handle.

The general vacuum cleaner as described above suctions dirt together with suction air via the suction opening 4 by the suctioning power of a motor (not shown) installed inside of the main body 1. The suctioned air and dirt enter the main body 1 via the extension pipes 3 and the connection hose 2. Here, the dirt is collected at the paper filter 7 in the dust collecting chamber 6 of the main body 1 and the suctioned air is exhausted to the outside of the main body 1 of the cleaner via the paper filter 7.

In the general vacuum cleaner as described above, however, since the dust and dirt suctioned via the suction opening 4 are all collected at one paper filter 7 in the dust collecting chamber 6 of the main body 1, the paper filter 7 can be easily filled with the dirt. If the paper filter 7 is filled with the dirt, the suctioning force becomes deteriorated and the motor may be overloaded. For this reason, the conventional vacuum cleaner is inconvenient in that the paper filter 7 should be frequently replaced.

To solve the above problem, a vacuum cleaner having a cyclone dust collecting device has been proposed. A cyclone is a device for separating particles in the fluid by using centrifugal force. This device has a simple structure. So, it has been widely used as a dust collector in the industry field and is being used for the vacuum cleaner.

Such a cyclone vacuum cleaner is constructed to primarily catch and collect the dirt of comparatively a relatively large particle size suctioned via the suction opening before the dirt enters the paper filter in the main body of the cleaner. Thus, the quantity of the dirt collected at the paper filter can be reduced and the paper filter can be used for a long time. Further, it has an advantage that the deterioration of the suctioning force and the overload of the motor can be prevented.

Representative examples of the cyclone vacuum cleaner as described above are Korea Utility Model Application No. 1993-4891 (laid-open No. 94-021983) the title of which is Vacuum Cleaner having Cyclone and Korea Patent No. 1993-5099 (laid-open No. 94-020998) the title of which is Vacuum Cleaner.

The former (Korean No. 93-4891) is structured such that a cyclone which can separate and collect the dirt is coaxially placed in the connection pipe of the cleaner. The cyclone has an outer tube, an inner tube disposed in the outer tube, a hopper placed at the lower portion of the inner tube, a suction hose for connecting the head of the cleaner to the outer tube, a vortex finder placed to pass through the inner tube and the top of the outer tube, and a cyclone inlet formed at one side of the inner tube. In such a vacuum cleaner, the dirt of a relatively large particle suctioned via the suction opening is caught and collected by the cyclone, thereby reducing the quantity of the dust collected at the paper filter in the main body of the cleaner.

In the meanwhile, the latter (Korean No. 93-5099) is structured such that a dirt separate collection device for separating and collecting the dirt is disposed at the connection pipe which connects the main body of the cleaner to the suction opening. The dirt separate collection device has a case which has first and second dust collecting chambers inside thereof, a vortex finder formed on top of the case, a connecting unit formed at the lower portion of the case to communicate with the first dust collection chamber, a cyclone separator which is received within the case and has a conical structure in which the inside diameter is gradually reduced from the upper portion to the lower portion thereof, a hopper which is combined to the lower end of the cyclone separator and has a conical structure in which the inside diameter is gradually increased from the upper portion to the lower portion thereof, an inlet filter which is combined to the center of the cyclone separator to separate the first dust collecting chamber from the second dust collecting chamber, a filter which is combined to the top of the cyclone separator to separate the second dust collecting chamber into two, and a vortex brake formed at the lower portion of the cyclone separator. This vacuum cleaner also catches and collects the dirt of large particle suctioned via the suction opening by the dirt separate collection device, thereby reducing the quantity of the dust collected at the paper filter in the main body of the cleaner.

In the conventional cyclone vacuum cleaners as described above, however, since the cyclone (or the dirt separate collection device) is coaxially placed at the extension pipe of the cleaner, the cyclone or the dirt separate collection device should be completely separated from the extension pipe of the cleaner to remove the dirt collected inside thereof.

In addition, the cyclone or the dirt separate collection device of the conventional cyclone vacuum cleaner has a complicated structure, causing difficulty in manufacturing and an increase in the manufacturing cost.

SUMMARY OF THE INVENTION

Accordingly, an object of the present invention is to provide a vacuum cleaner having a cyclone dust collecting device which can simply remove the dirt collected at the dust collecting device without completely separating the cyclone dust collecting device from an extension pipe of the cleaner.

Another object of the present invention is to provide a vacuum cleaner having a cyclone dust collecting device which has a simple structure so that it can be easily manufactured and is profitable for mass production due to the low manufacturing cost.

To achieve the above objects, the vacuum cleaner of the present invention has a cyclone dust collecting device which is placed at an extension pipe for connecting a main body of the cleaner to a suction opening and separates and collects dust and dirt of comparatively large particle size suctioned via the suction opening by the centrifugal force. The cyclone dust collecting device is placed in a different axis with respect to the extension pipe of the cleaner, so that it is possible to remove the dirt collected by the cyclone dust collecting device without completely separating the cyclone dust collecting device from the extension pipe.

The cyclone dust collecting device includes a cyclone body having first and second connecting tubes connected to the extension pipe of the cleaner, a dirt collecting tub connected to the cyclone body to be removable, and locking means for supporting the dirt collecting tub.

The cyclone body is separated into an upper body unit and a lower body unit and the upper and lower body units are assembled by a plurality of screws. An air inlet communicating with the first connecting tube is formed at the lower body unit and an air outlet communicating with the second connecting tube is formed at the upper body unit. The first connecting tube is connected to the extension pipe near the suction opening of the cleaner and the second connection tube is connected to the extension pipe near the main body of the cleaner. The dirt-containing air suctioned via the suction opening of the cleaner flows in via the air inlet of the cyclone body in an oblique direction against the cyclone body, so that a whirlpool air current is formed inside of the cyclone body. By such a whirlpool air current, the dirt contained in the air is separated from the air by the centrifugal force and then is collected at the dirt collecting tub, and the air starts a reverse rising movement from the bottom and is exhausted via the air outlet.

In this case, the dust may flow upstream together with the air via the air outlet of the cyclone body. To prevent this problem, the cyclone dust connecting device of the present invention includes a dirt separating grill having a plurality of holes which is placed to be downwardly extended from the air outlet of the cyclone body, so that the air rising from the dirt collecting tub passes through the holes, while dirt which is larger than the holes cannot pass through the holes and descends again to be collected at the dirt collecting tub.

Further, dirt blocking means for blocking the dirt rising together with the air before it reaches the dirt separating grill and then causing the dirt to descend again is formed at the lower portion of the dirt separating grill. Accordingly, dirt cannot completely rise to the upper portion of the cyclone body and is blocked so as to descend again. Therefore, it is possible to remarkably reduce the quantity of the dirt which flows upstream via the holes of the dirt separating grill and prevent the dirt from blocking up the holes of the dirt separating grill.

The dirt blocking means may be structured such that a dirt blocking plate of conical shape wherein the width is increased from the upper portion to the lower portion is formed at the lower end of the dirt separating grill, or such that an additional conical dirt blocking rotation plate is placed at the lower portion of the dirt separating grill to be rotatable by the whirlpool air current. In addition, a supplemental blocking member may be placed at the lower portion of the dirt blocking plate or dirt blocking rotation plate. The supplemental blocking member may be formed of a brush and is positioned a downward extension unit of the dirt blocking plate or dirt blocking rotation plate.

The dirt collecting tub is formed of a cylindrical shape and of a solid construction so as not to be easily broken by external impact. A supporting unit for supporting the dirt collecting tub against the extension pipe is formed at one side of the lower portion of the dirt collecting tub. The supporting unit is inserted to a slide groove of a fixing ring which is to be fixed to the extension pipe and is assembled to the cyclone body by combining the upper portion of the dirt collecting tub to the cyclone body by a locking means. The dirt collecting tub may be formed of a cylindrical shape with a predetermined diameter or as a reducing shaped tube wherein the diameter thereof becomes reduced as it goes from the upper portion to the lower portion. In addition, the dirt collecting tub may be formed to be an extended shaped tube wherein the diameter of the lower portion is greater than that of the upper portion. In the case of the extended shaped extending shape tube, the rotation speed of the air in the dirt collecting tub can be reduced as it goes to the lower portion of the tube, thus preventing the backward flow of the dirt. The extended shaped tube dirt collecting tub has a first cylindrical unit which is formed at the upper portion and a second cylindrical unit which is formed at the lower portion and has a diameter greater than that of the first cylindrical unit. Accordingly, the air suctioned to the dirt collecting tub rotates in the first cylindrical unit at a comparatively high speed to separate the dirt, and the air rotates in the second cylindrical unit at a slow speed. Thus, it is possible to minimize the quantity of the dirt which has risen with the whirlpool air current. The second cylindrical unit may be formed to be such that the diameter of the lower portion becomes greater than that of the upper portion or to be a simple cylindrical shape the diameter of which is greater than that of the first cylindrical unit.

The locking means has a pair of suspension holes formed at both sides of the lower body; a pair of lockers which are hinge-combined to a pair of locker supporting units formed at both sides of the upper portion of the dirt collecting tub and have hooks which are formed at the end thereof and are to be hooked to the suspension holes; and a spring which is disposed between the inside of the rear end of the locker and the locker supporting unit of the dirt collecting tub and elastically supports the locker in one direction. Here, each locker is elastically supported by the spring in the direction to which the hook thereof is hooked to the suspension hole of the lower body. Thus, if the dirt collecting tub is inserted to the lower body of the cyclone body, the hook of the locker is inserted to the suspension hole and then the dirt collecting tub is connected to the cyclone body. The dirt collecting tub can be separated from the cyclone body by pushing and pulling both lockers. Then, the hooks of the lockers are released from the suspension holes of the lower body and the supporting unit at the lower portion of the dirt collecting tub is released from the fixing ring of the extension pipe. Accordingly, only the dirt collecting tub can be separated and the dirt collected therein can be conveniently removed.

According to a preferred embodiment of the present invention, the cyclone dust collecting device for separating and collecting comparatively large particles of dirt suctioned from the suction opening by the centrifugal force is placed in a different axis with respect to the extension pipe. The cyclone dust collecting device includes a cyclone body which has first and second connecting tubes connected to the extension pipe of the cleaner, an air inlet communicating with the first connecting tube and formed at one side thereof and an air outlet communicating with the second connecting tube and formed at the other side thereof and produces the whirlpool air current; a dirt collecting tub which is connected to the cyclone body to be removable and collects the dirt separated from the air; a dirt separating grill which is placed to be downwardly extended from the air outlet of the cyclone body and has a plurality of holes of a size to prevent dirt from flowing backward to the air outlet of the cyclone body together with the air; a dirt blocking unit, which is placed at the lower end of the dirt separating grill, blocks the dirt rising in the air in the rising air current before the dirt reaches the dirt separating grill and then it descends again; and a locking unit which supports the dirt collecting tub to make the dirt collecting tub removable from the cyclone body.

According to the above description, since the cyclone dust collecting device primarily catches and collects dust or dirt of comparatively large particle size, the period for replacing the paper filter of the cleaner can be extended.

Further, if the dirt collecting tub of the cyclone dust collecting device is filled with the dirt, the dirt can be removed by simply separating the dirt collecting tub without completely separating the cyclone dust collecting device from the extension pipe of the cleaner.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
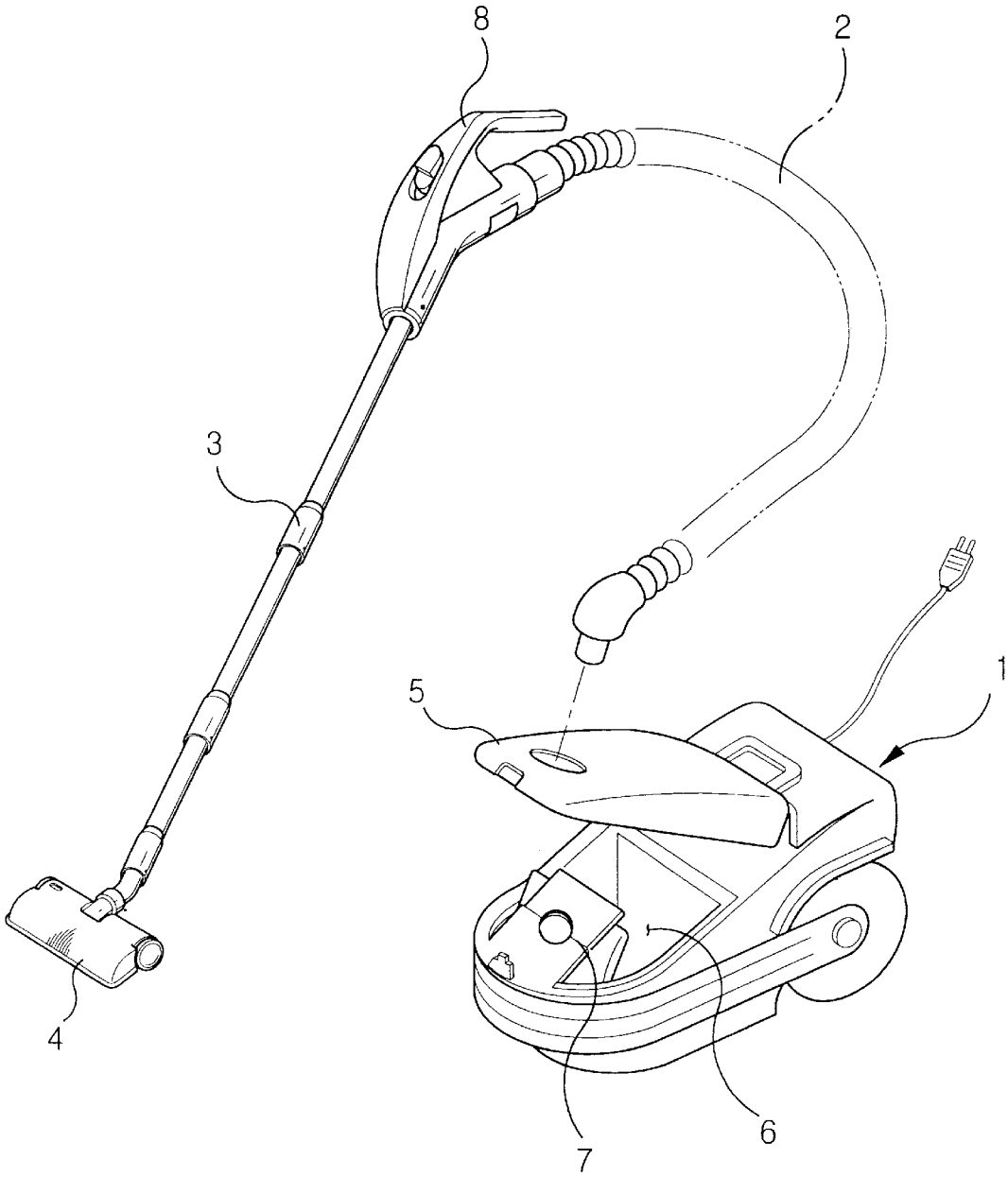
FIG. 1 (PRIOR ART)
FIG. 1 is a perspective view showing a general vacuum cleaner.

A vacuum cleaner having a cyclone dust collecting device according to a preferred embodiment of the present invention is shown in FIGS. 2 to 5.

It is noted that the same reference numerals will be used to designate like or equivalent elements having the same functions. The detail description thereof will be omitted if possible and the description will be concentrated on the characteristic parts of the present invention.

In the figures, a reference numeral 1 represents a main body of the cleaner, a reference numeral 2 represents a connection hose, a reference numeral 3 represents an extension pipe, a reference numeral 4 represents a suction opening, a reference numeral 5 represents a cover, a reference numeral 6 represents a dust collecting chamber, a reference numeral 7 represents a paper filter, a reference numeral 8 represents a handle grip, and a reference numeral 10 represents a cyclone dust collecting device.

Figure 2:
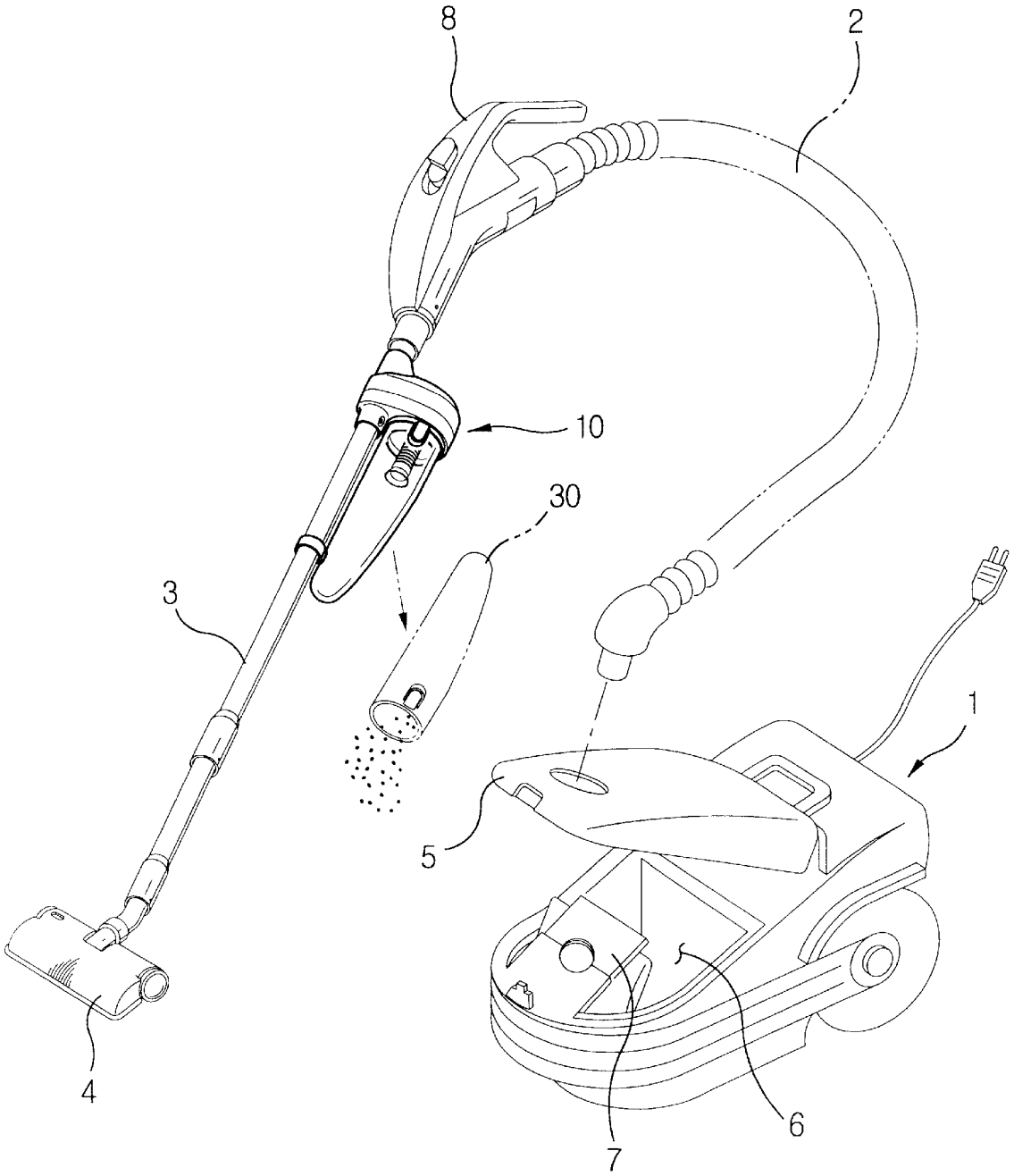
FIG. 2 is a perspective view showing a vacuum cleaner having a cyclone dust collecting device according to the present invention.
Figure 3:
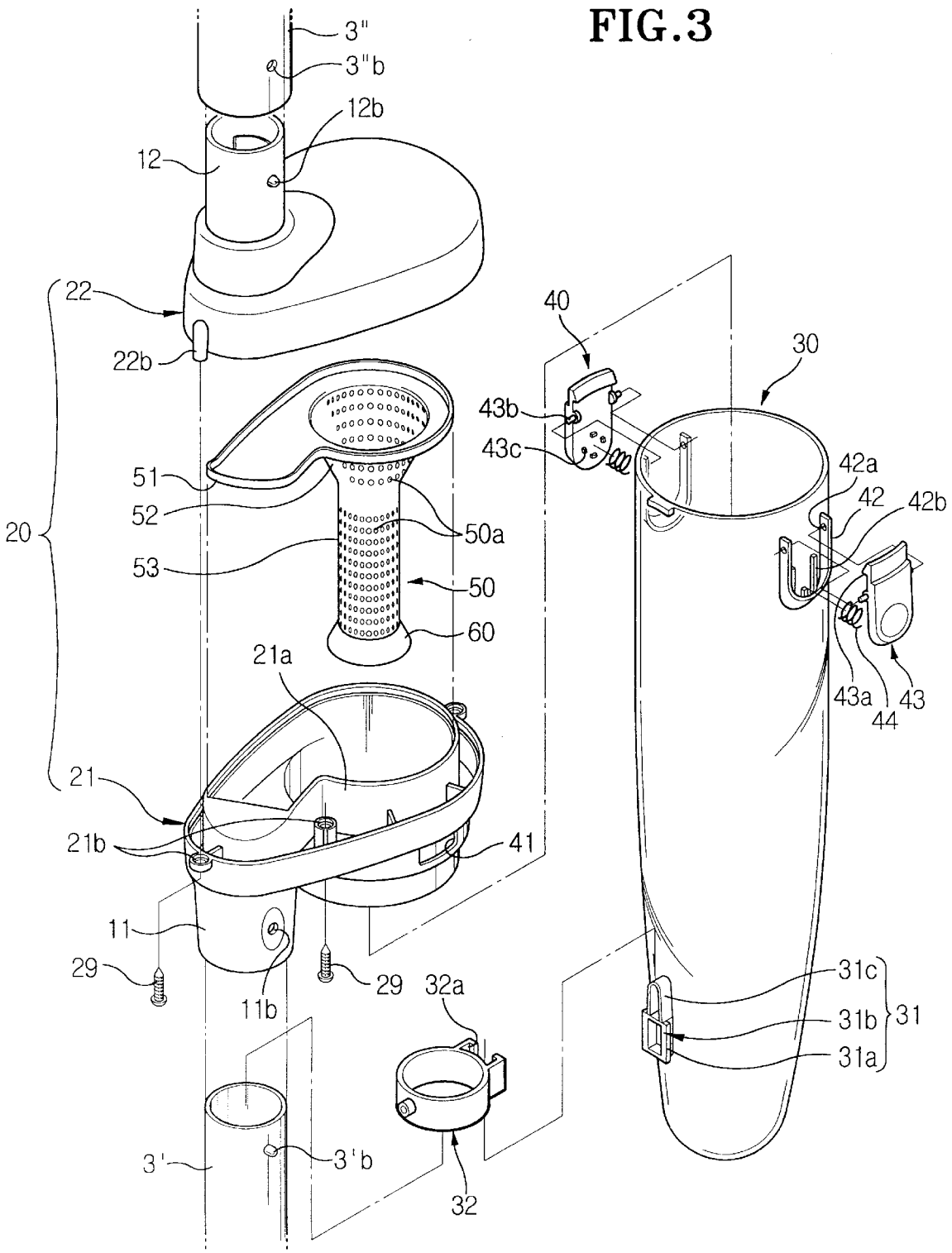
FIG. 3 is an exploded perspective view showing a cyclone dust collecting device according to a first preferred embodiment of the present invention.
Figure 4:
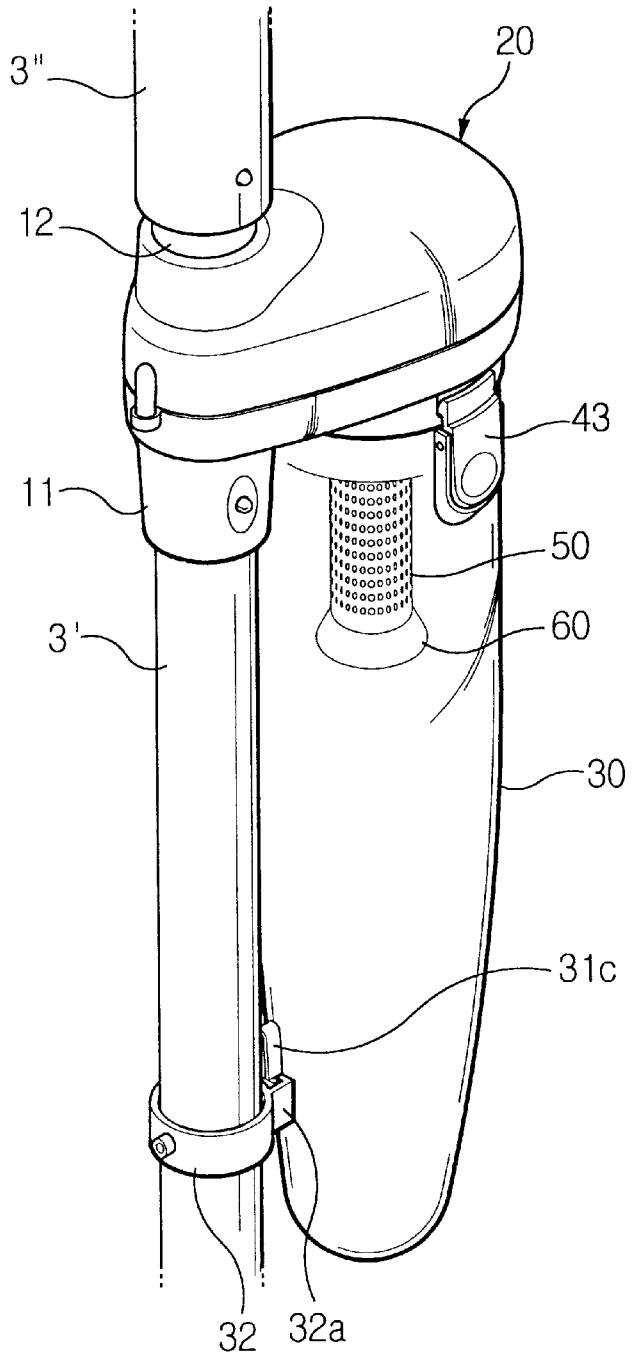
FIG. 4 is a perspective view showing the assembling of the cyclone dust collecting device of FIG. 3.

As shown in FIG. 2, the cyclone dust collecting device 10 is connected to the extension pipe 3 which connects the main body 1 of the cleaner to the suction opening 4.

The cyclone dust collecting device 10 includes a cyclone body 20 having first and second connecting tubes 11 and 12 which are connected to the extension pipe 3, a dirt collecting tub 30 connected to the cyclone body 20 to be removable, and a locking unit 40 which supports the dirt collecting tub 30 to make the dirt collecting tub 30 removable from the cyclone body 20.

Figure 5:
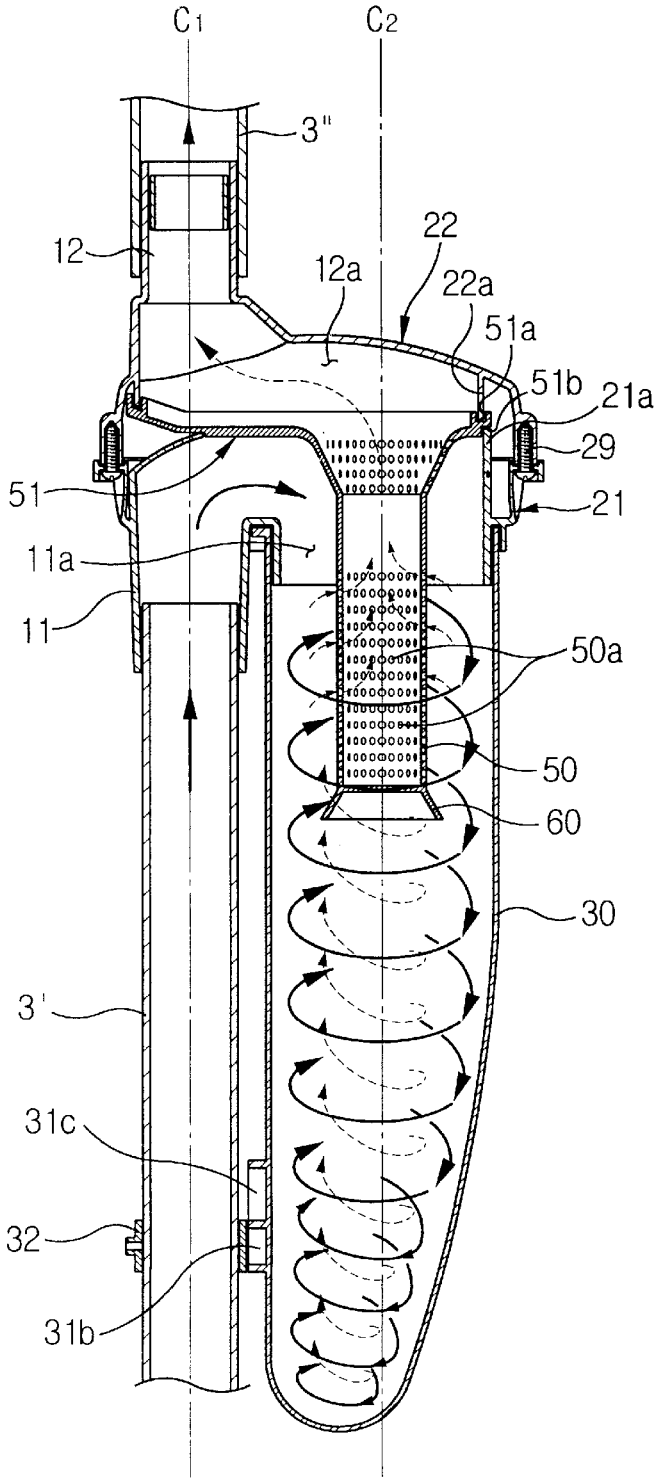
FIG. 5 is a cross sectional view for explaining the dust collecting operation of the cyclone dust collecting device of FIG. 4.

The first and second connecting tubes 11 and 12 of the cyclone body 20 are formed to be located off the center of the cyclone body 20. With this construction, the cyclone dust collecting device is connected to the extension pipe 3 of the cleaner, the center of the cyclone dust collecting device, or, the central axis C2 of the dirt collecting tub 30, is not placed on 1 the axis C1 of the extension pipe 3 but is placed in a different axis, as shown in FIG. 5. Thus, there is no need to separate the extension pipe of the cleaner in order to remove the dirt collected at the dirt collecting tub 30. That is, as shown in FIG. 2, the dirt can be easily removed by separating only the dirt collecting tub 30 from the cyclone body 20.

The cyclone body 20 is divided into a lower body unit 21 which is united to the first connecting tube 11 and an upper body unit 22 which is united to the second connecting tube 12 and the upper and lower body units 22 and 21 are connected to each other by a plurality of screws 29.

An air inlet 11*a* communicating with the first connecting tube 11 is formed at the lower body unit 21 and an air outlet 12*a* communicating with the second connecting tube 12 is formed at the upper body unit 22. Here, the air inlet 11*a* and the air outlet 12*a* are formed by dividing the insides of the upper and lower body units 22 and 21 by curve ribs 22*a* and 21*a*, respectively. In addition, several pairs of fixing bosses 22*b* and 21*b* each having a screw hole at a predetermined position are formed to face each other at the upper and lower body units 22 and 21. A hole 11*b* and a projection 12*b* for combining the cyclone dust collecting device to the extension pipes 3' and 3" are formed at the first and second connecting tubes 11 and 12, respectively, and a projection 3'*b* and a removable hole 3"*b* which correspond to the removable hole 11*b* and the projection 12*b* are formed at the extension pipes 3' and 3 ", respectively.

The first connecting tube 11 is connected to the extension pipe 3' near the suction opening 4 of the cleaner, and the second connecting tube 12 is connected to the extension pipe 3" near the main body 1 of the cleaner. The dirt-containing air suctioned via the suction opening 4 of the cleaner flows via the air inlet 11*a* of the first connecting tube 11 in an oblique direction against the cyclone body 20, so that the whirlpool air current (shown as circular arrows indicated by a solid line in FIG. 5) is generated inside of the cyclone body 20 and the dirt collecting tub 30. By such a whirlpool air current, the dirt particles contained in the air are separated from the air and then descend, while the air is exhausted to the main body 1 of the cleaner via the air outlet 12*a* of the cyclone body 20 by the rising air current (shown as circular arrows indicated by a dotted line in FIG. 5) upwardly generated from the bottom of the dirt collecting tub 30.

The dirt collecting tub 30 is connected to the cyclone body 20 to be removable by the locking unit 40. It serves to form the whirlpool air current together with the cyclone body 20 and to collect the dirt separated from the air with centrifugal force by the whirlpool air current.

The dirt collecting tub 30 is generally formed of a cylindrical shape, but the shape thereof may be varied. But, in consideration of the external appearance, it may be formed to be of a reduced cylindrical shape in which the diameter of the lower portion is smaller than that of the upper portion.

Further, in order to easily check the dirt collected inside of the dirt collecting tub 30 from the outside, it is preferable that the dirt collecting tub 30 is made of a translucent material, but there is no need to limit the material of the dirt collecting tub 30 to the translucent material. Also, it is preferable that the dirt collecting tub 30 is made of a material providing a solid construction so that it cannot be easily broken by external impact or dropping.

A supporting unit 31 for supporting the dirt collecting tub 30 in connection with the extension pipe 3 of the cleaner is formed at one side of the circumference of the lower portion of the dirt collecting tub 30. The supporting unit 31 is inserted to a slide groove 32*a* of a fixing ring 32 placed at the extension pipe 3. The supporting unit 31 includes a fixing projection 31*b* having a suspension jaw 31*a* which is fixed by being inserted to the slide groove 32*a* of the fixing ring 32, and a guide projection 31*c* which is formed in front of the fixing projection 31*b* to guide the insertion of the fixing projection 31*b* to the slide groove 32*a*. The guide projection 31*c* is formed to be of a shape such that the width becomes narrower from the portion near the fixing projection 31*b* to the upper portion. The fixing ring 32 is fixed to the extension pipe 3 by a screw(not shown).

The locking unit 40 includes a pair of suspension holes 41 formed to face each other at both sides of the lower body unit 21, a pair of lockers 43 which are hinge-combined to a pair of locker supporting units 42 formed at both sides of the upper portion of the dirt collecting tub 30 and have hooks 43*a* hooked to the suspension holes 41 and formed at the end thereof, and a pair of springs 44 which are placed between the inside of the rear end of the locker 43 and the locker supporting unit 42 of the dirt collecting tub 30 and elastically support the lockers 43 in one direction.

The locker supporting unit 42 is generally formed to be of U shape, and a pair of hinge holes 42*a* and a spring supporting projection 42*b* are formed at predetermined positions, respectively. The locker 43 is placed to be rotated by a predetermined angle around the hinge projection 43*b* by the insertion of a pair of hinge projections 43*b* to the hinge holes 42*a* of the locker supporting unit 42. A spring supporting projection 43*c* for supporting the spring 44 is formed at the inner surface of the locker 43. Here, the spring 44 elastically supports the locker 43 in the direction in which the hook 43*a* is hooked in the suspension hole 41. Thus, if the dirt collecting tub 30 is inserted for connection to the lower body unit 21 of the cyclone body 20, the hook 43*a* of the locker 43 is inserted in the suspension hole 41 and then the dirt collecting tub 30 is connected to the cyclone body 20. The dirt collecting tub 30 can be separated from the cyclone body 20 by pushing and pulling both lockers 43. Then, the hooks 43*a* of the lockers 43 are released from the suspension hole 41 of the lower body unit 21 and the supporting unit 31 at the lower portion of the dirt collecting tub 30 is released from the fixing ring 32 of the extension pipe 3, thereby conveniently removing the dirt collected inside of the dirt collecting tub 30 by separating only the dirt collecting tub 30.

Further, a reference numeral 50 represents a dirt separating grill. The dirt separating grill 50 serves to prevent the dust from flowing backward together with the air via the air outlet 12*a* of the cyclone body 20 when the cyclone dust collecting device is operated. The dirt separating grill 50 is placed to be downwardly extended from the air outlet 12*a* and has a plurality of holes 50*a*, of a size such that the air from the dirt collecting tub 30 is exhausted via the holes 50*a*, while the dirt larger than the size of the holes 50*a* cannot pass through the holes 50*a* but descend again to be collected at the dirt collecting tub 30.

The dirt separating grill 50 has a grill guide unit 51 formed at the upper portion, a conical shaped grill unit 52 the inside of which is hollow and a cylindrical shaped grill unit 53 the lower portion of which is blocked. The minute passing holes 50*a* are formed near the air inlet 11*a* in the conical shaped grill unit 52 and in the cylindrical shaped grill unit 53.

The grill guide unit 51 supported by the curve ribs 22*a* and 21*a* respectively formed at the upper and lower body units 22 and 21, positions the dirt separating grill 50. A rib groove 51*a* for receiving the curve rib 22*a* of the upper body unit 22 is formed at the edge of the upper surface of the grill guide unit 51 and an end jaw unit 51*b* to which the curve rib 21*a* of the lower body unit 21 is closely mounted is formed at the other surface of the grill guide unit 51.

In addition, a dirt blocking plate 60 of a conical shape in which the width of the lower portion is greater than that of the upper portion is formed at the lower end of the dirt separating grill 50.

The dirt blocking plate 60 serves to block the dirt in the air before the dirt reaches the dirt separating grill 50 and the dirt again descends. Accordingly, the dirt cannot completely rise to the upper portion of the cyclone body 20 but is blocked so as to descend again, so that it is possible to remarkably reduce the quantity of the dirt flowing backward via the holes 50*a* of the dirt separating grill 50, and it is also possible to prevent the dirt of a relatively large size from blocking the holes 50*a* of the dirt separating grill 50.

Hereinafter, a description will be made on the operation of the vacuum cleaner having the cyclone dust collecting device as described above.

When electric power is applied, suctioning force is produced by the driving of a motor in the main body 1 of the cleaner. Then, the dirt or dust enters the inside of the cyclone dust collecting device via the suction opening 4 and the first connecting tube 11 together with the suction air, as shown in FIG. 5. In this case, the air which enters the cyclone dust collecting device flows in a slanting direction against the cyclone body 20 by the air inlet 11*a* of the first connecting tube 11. Accordingly, the air produces a whirlpool air current and descends to the lower portion of the dirt collecting tub 30. In this process, dirt of a relatively large particle size in the air is separated from the air by centrifugal force and descends along the inner side wall of the dirt collecting tub 30 to be collected in the dirt collecting tub 30. Also, the air starts a reverse rising movement from the bottom of the dirt collecting tub 30 and is exhausted to the main body 1 of the cleaner via the air outlet 12*a* and the second connecting tube 12 by the rising air current. In this case, the dirt of a relatively large particle size rising together with the air by the rising air current cannot pass through the holes 50*a* of the dirt separating grill 50 and descends again to be collected at the dirt collecting tub 30. Also, some dirt particles of a relatively large size impact against the dirt blocking plate 60 and then descend again to be collected. The dust collecting process performed at the main body 1 is the same as that of a general vacuum cleaner.

If the dirt collecting tub 30 is filled with the dirt which has been separated and collected by such a process as described above, the collected dirt is removed by separating only the dirt collecting tub 30 from the cyclone body 20 without separating the cyclone dust collecting device from the extension pipe.

Figure 6:
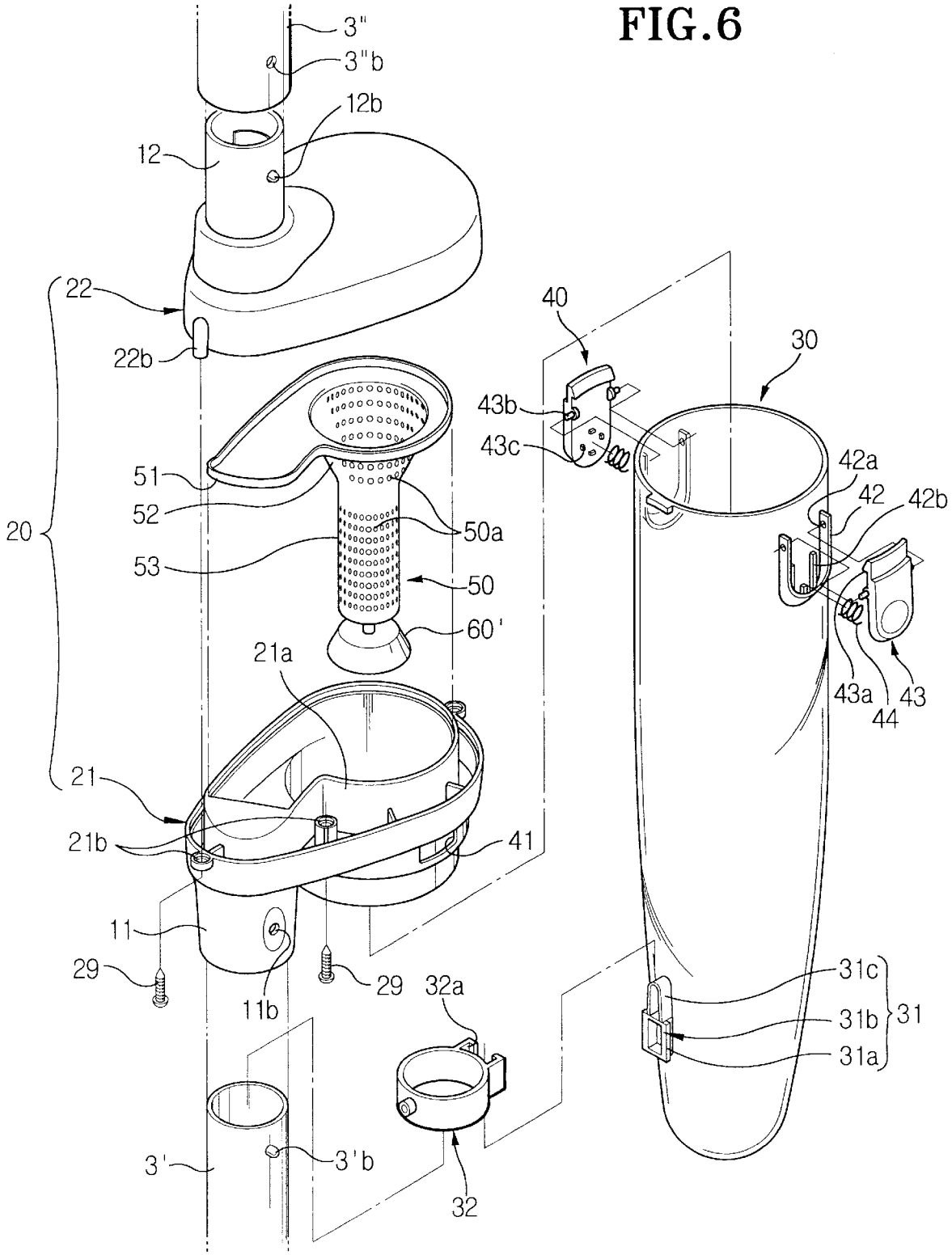
FIG. 6 is an exploded perspective view showing a cyclone dust collecting device according to a second preferred embodiment of the present invention.
Figure 7:
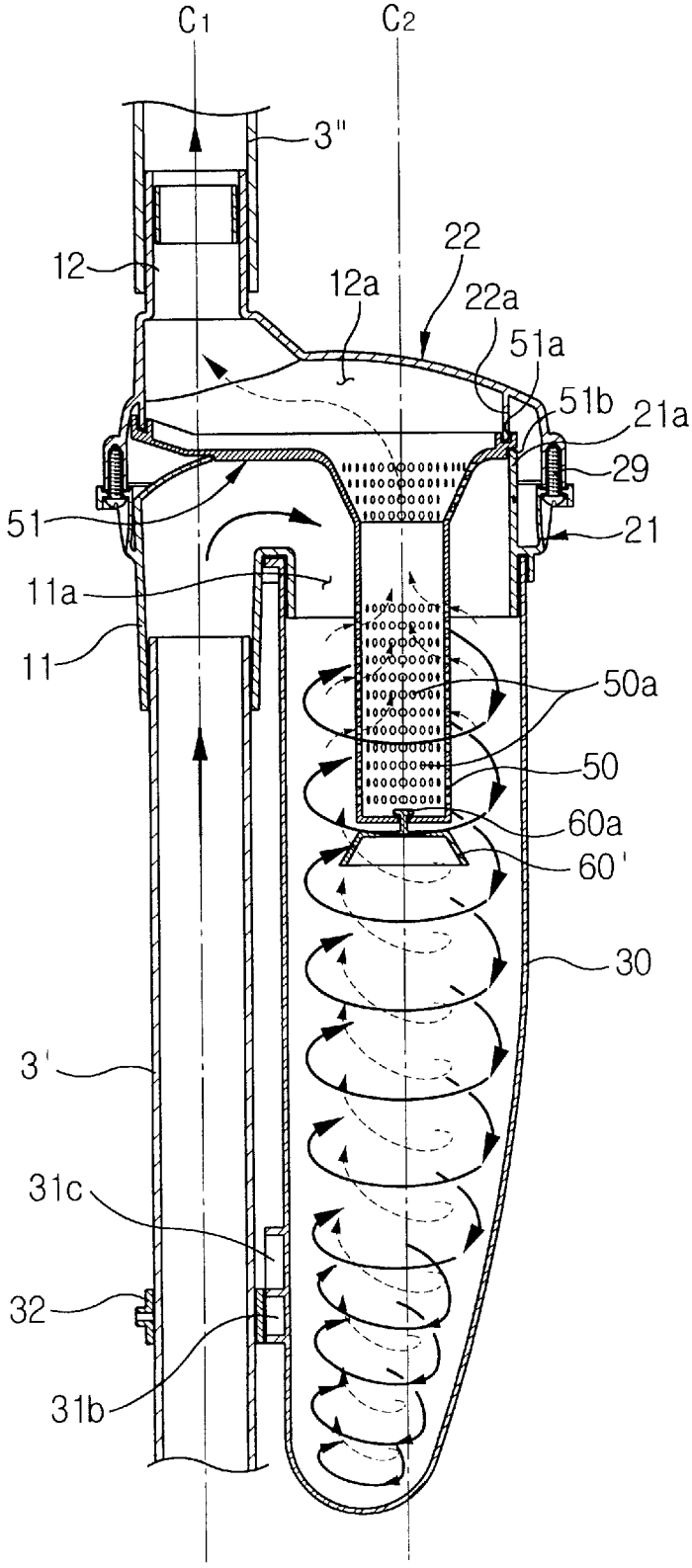
FIG. 7 is a cross sectional view for explaining the dust collecting operation of the cyclone dust collecting device of FIG. 6.

FIG. 6 is an exploded perspective view showing a cyclone dust collecting device according to a second preferred embodiment of the present invention, and FIG. 7 is a cross sectional view for explaining the dust collecting operation of the cyclone dust collecting device of FIGS. 6 and 7.

As shown in the figures, the basic construction of the cyclone dust collecting device according to a second preferred embodiment of the present invention is the same as that according to the first preferred embodiment of the present invention, except that in constructing the dirt blocking unit at the lower portion of the dirt separating grill 50, an additional dirt blocking rotation plate 60' is placed so as to be rotated by the rising air.

The dirt blocking rotation plate 60' is rotated by a whirlpool air current produced inside of the dirt collecting tub 30, thereby effectively causing dirt which impacts the dirt blocking rotation plate 60' to descend in the dirt collecting tub 30.

The dirt blocking rotation plate 60' is of a conical shape in which the width of the lower portion is greater than that of the upper portion. The protrusion 60*a* formed at the center of the upper portion of the dirt blocking rotation plate 60' is inserted to an axis hole formed at the center of the lower portion of the dirt separating grill 50 to enable the dirt blocking rotation plate 60' to be rotated. The construction of such a dirt blocking rotation plate is well known in the art.

The other constructions and the operating effect are the same as those of the first preferred embodiment of the present invention and the detailed description thereof will be omitted.

Figure 8:
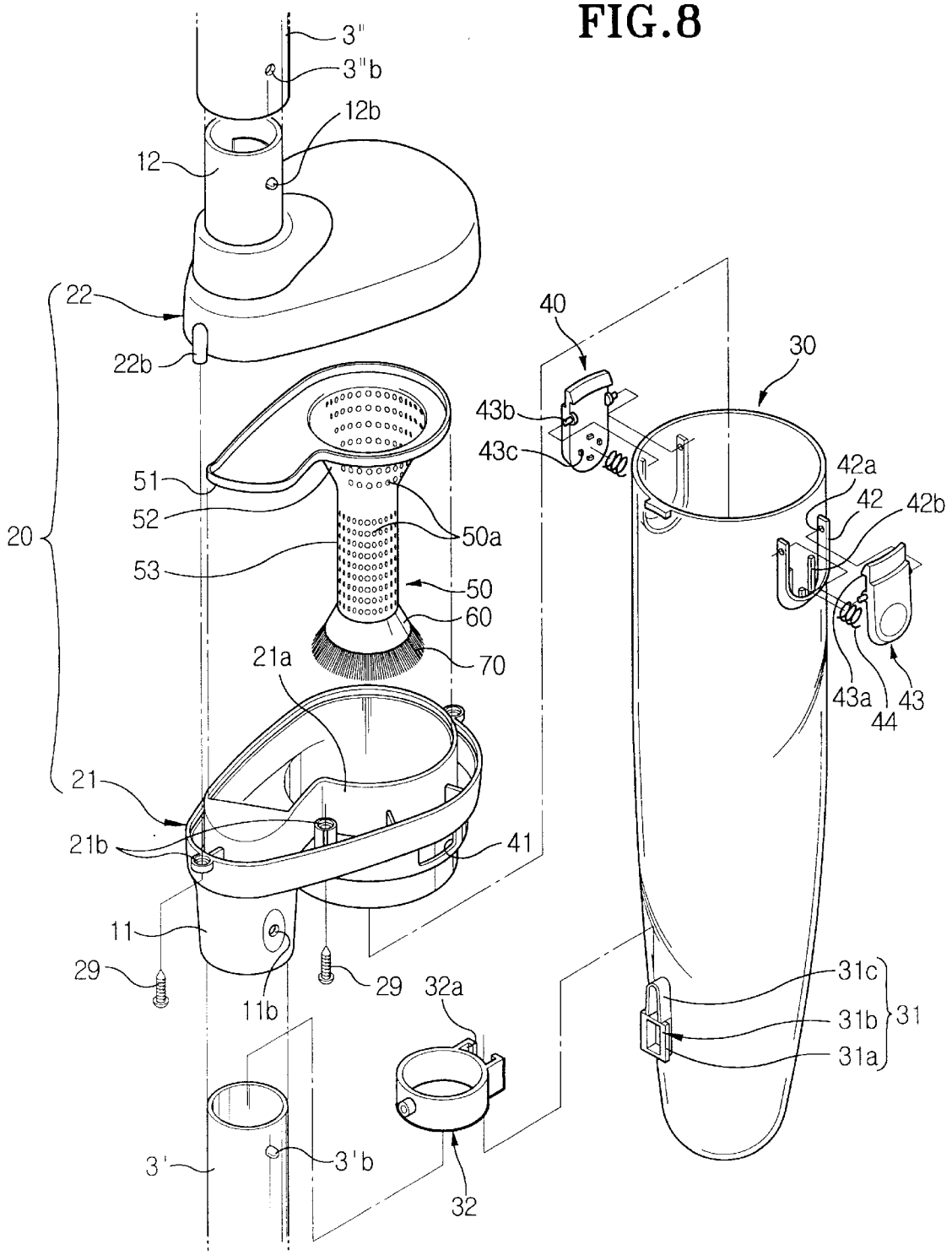
FIG. 8 is an exploded perspective view showing a cyclone dust collecting device according to a third preferred embodiment of the present invention.
Figure 9:
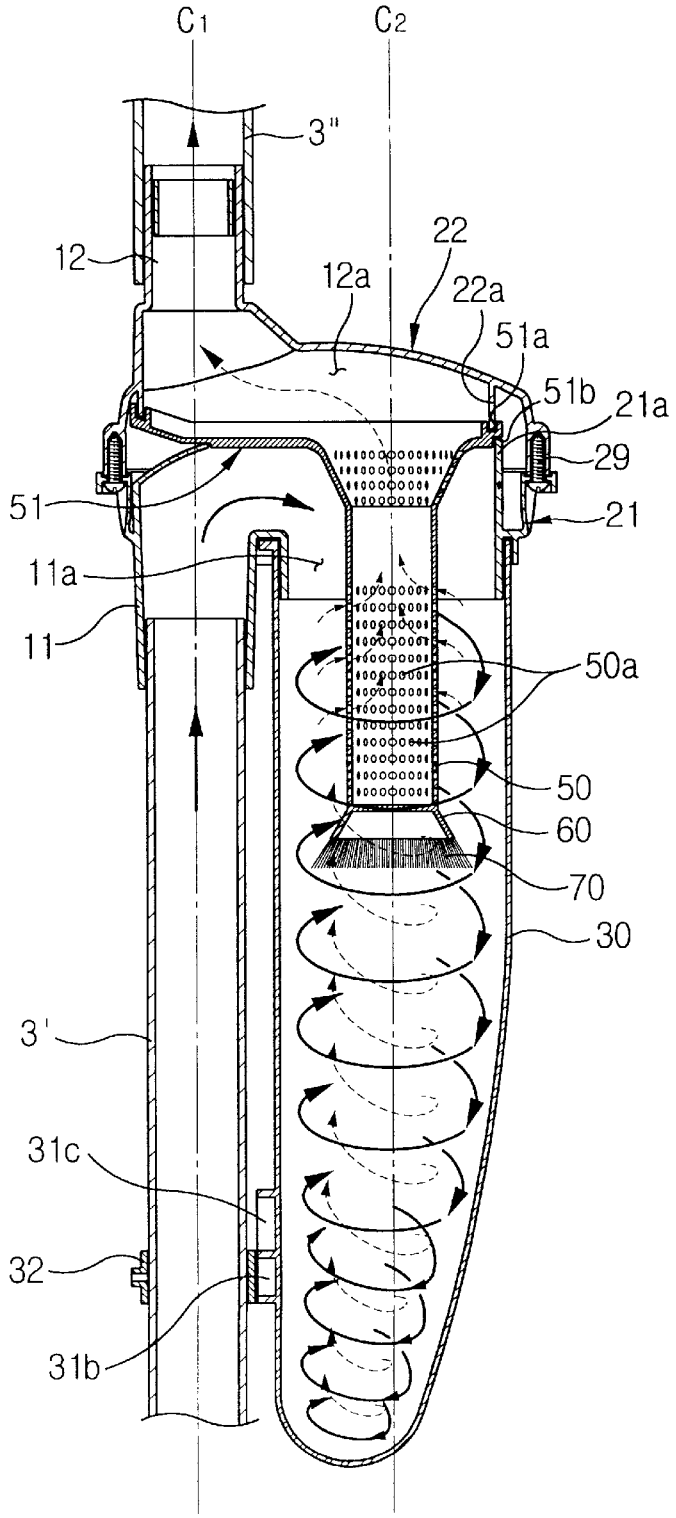
FIG. 9 is a cross sectional view for explaining the dust collecting operation of the cyclone dust collecting device of FIG. 8.

FIG. 8 is an exploded perspective view showing a cyclone dust collecting device according to a third preferred embodiment of the present invention and FIG. 9 is a cross sectional view for explaining the dust collecting operation of the cyclone dust collecting device of FIG. 8.

The cyclone dust collecting device according to a third preferred embodiment of the present invention has a supplemental blocking member 70 for supplementing the operation of the dirt blocking plate 60.

The supplemental blocking member 70 may be formed of a brush and is placed along the edge of the lower end of the dirt blocking plate 60. In this case, the supplemental blocking member 70 is positioned as a downward extension unit of the dirt blocking plate 60.

Accordingly, it is possible to more effectively block the dirt rising in with the air in the dirt collecting tub 30.

The other constructions and the operating effect are the same as those of the first and second preferred embodiments of the present invention and the detailed description thereof will be omitted.

Figure 10:
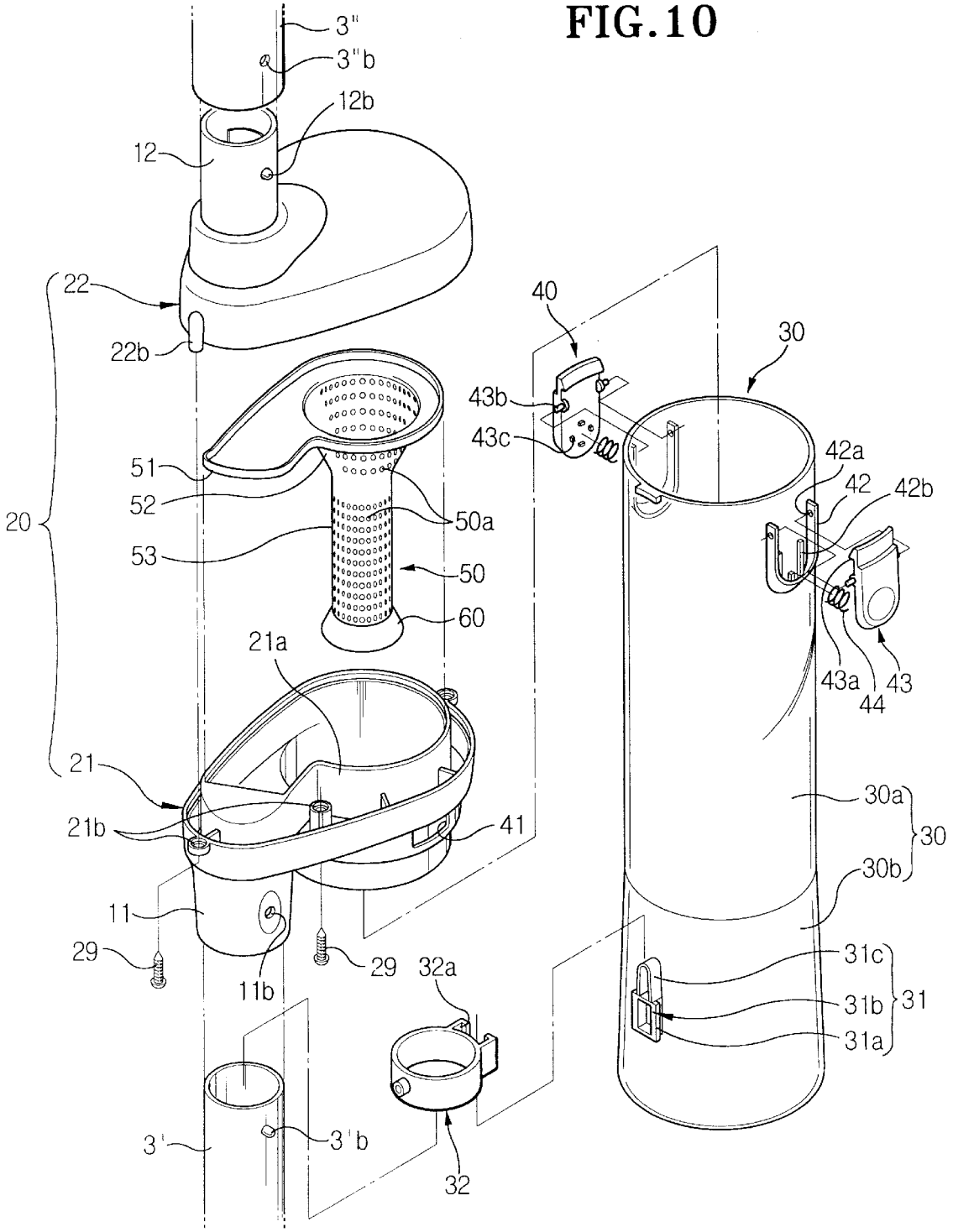
FIG. 10 is an exploded perspective view showing a cyclone dust collecting device according to a fourth preferred embodiment of the present invention.
Figure 11:
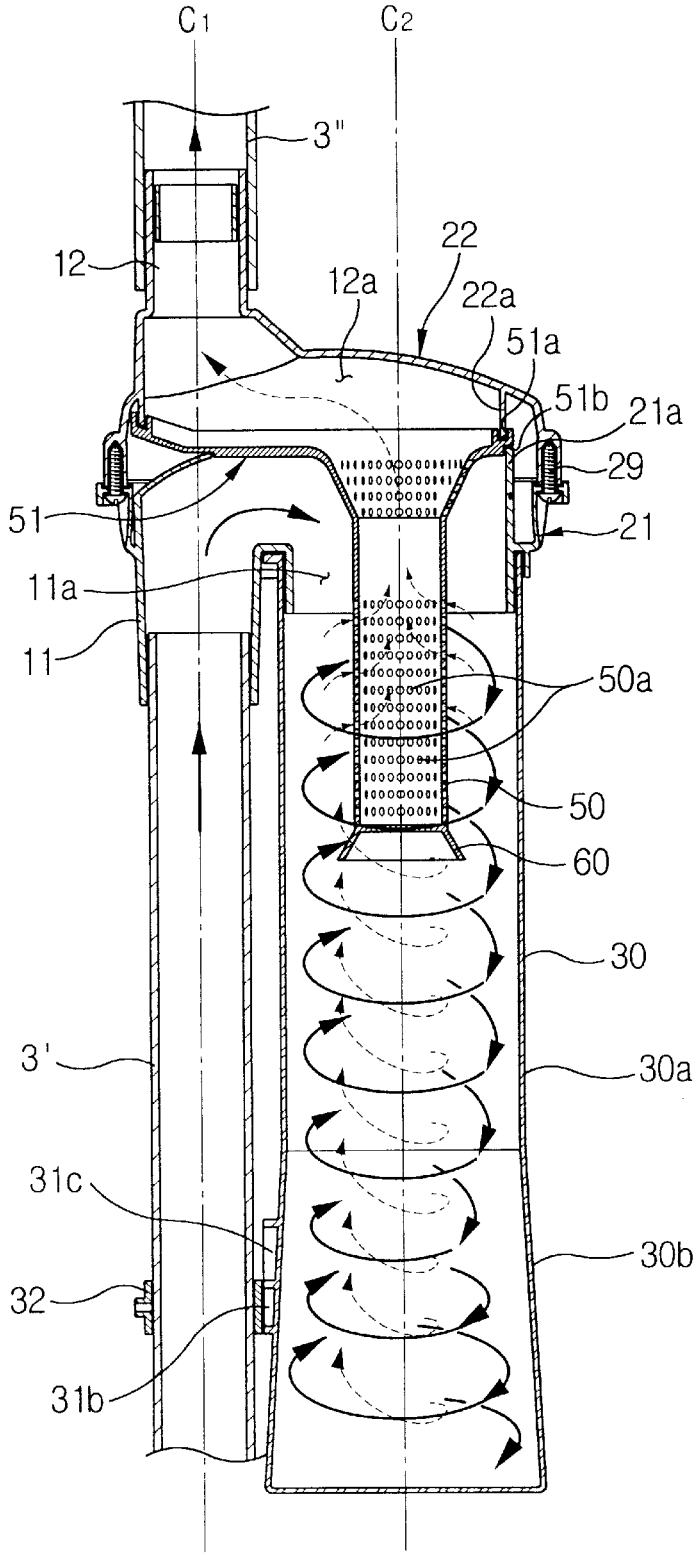
FIG. 11 is a cross sectional view for explaining the dust collecting operation of the cyclone dust collecting device of FIG. 10.
Figure 12:
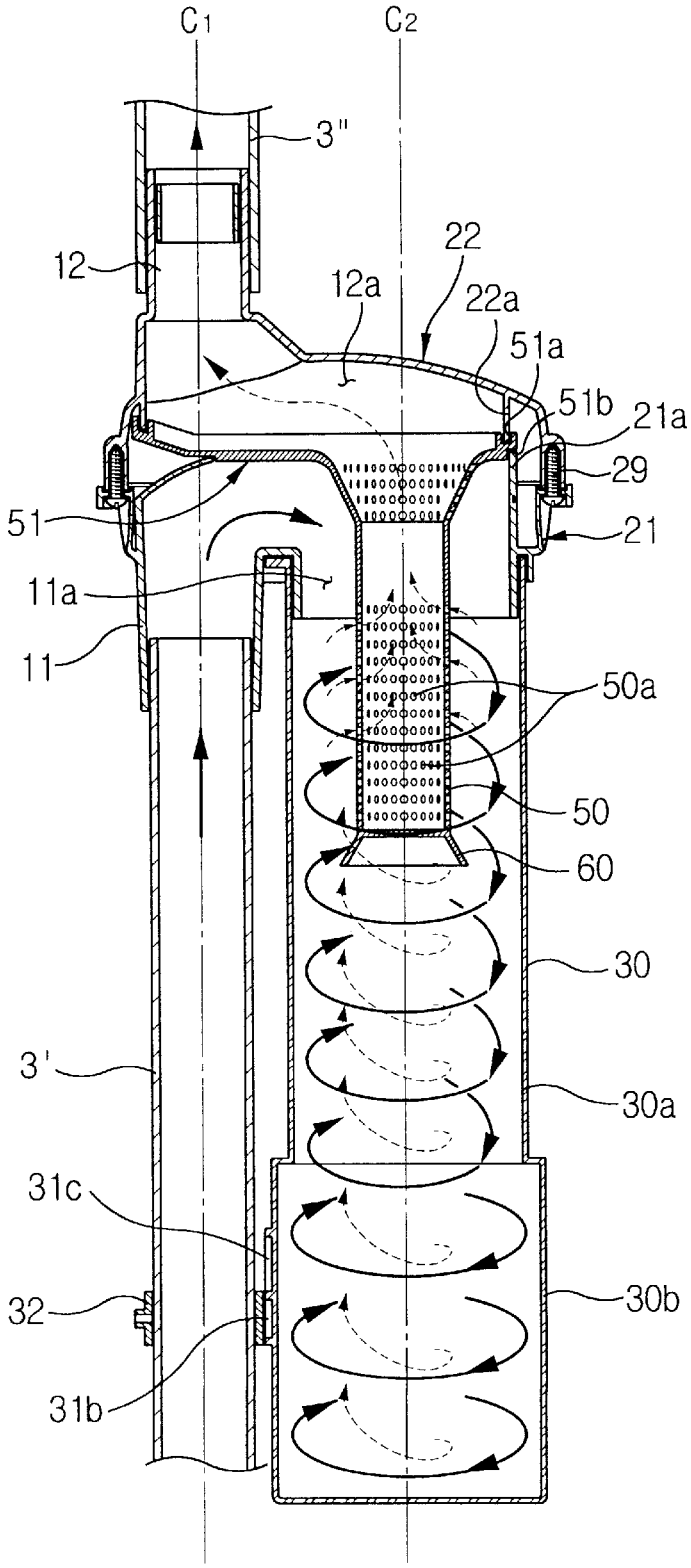
FIG. 12 is across sectional view showing a cyclone dust collecting device according to a fifth preferred embodiment of the present invention.

FIG. 10 is an exploded perspective view showing a cyclone dust collecting device according to a fourth preferred embodiment of the present invention and FIG. 11 is a cross sectional view for explaining the dust collecting operation of the cyclone dust collecting device of FIG. 10. FIG. 12 is a cross sectional view showing a cyclone dust collecting device according to a fifth preferred embodiment of the present invention.

The basic construction of the cyclone dust collecting device according to the fourth and fifth preferred embodiments of the present invention is the same as that according to the first preferred embodiment of the present invention, except that the dirt collecting tub 30 is composed of a first cylindrical unit 30*a* with a predetermined diameter which is formed at the upper portion thereof and a second cylindrical unit 30*b* which is formed at the lower portion thereof and has a greater diameter than the first cylindrical unit 30*a*.

Accordingly, the whirlpool air current produced in the dirt collecting tub 30 rotates at a comparatively high speed in the first cylindrical unit 30*a* and rotates at a relatively slow speed in the second cylindrical unit 30*b*. Thus, it is possible to minimize the quantity of dirt which has risen from the bottom of the second cylindrical unit 30*b* with a whirlpool air current.

The second cylindrical unit 30*b* may be formed to be of a conical shape in which the diameter of the upper portion is smaller than that of the lower portion, as shown in FIG. 11, or of a simple cylindrical shape the diameter of which is greater than that of the first cylindrical unit 30*a*, as shown in FIG. 12.

The other constructions and the operating effect are the same as those of the first and second preferred embodiments of the present invention and the detailed description thereof will be omitted.

As described above, since dirt of a relatively large particle size contained in the air suctioned via the suction opening is primarily collected by the cyclone dust collecting device, the present invention can remarkably reduce the quantity of dirt collected at the paper filter of the main body of the cleaner. Therefore, it is possible to extend the period for replacing the paper filter.

In addition, if the dirt collecting tub of the cyclone dust collecting device is filled with dirt, the dirt can be removed by simply separating the dirt collecting tub without separating the cyclone dust collecting device from the extension pipe.

Further, according to the other preferred embodiments of the present invention, it is possible to effectively prevent the backward flowing of the dirt collected at the dirt collecting tub, thus reducing the quantity of the dirt collected at the paper filter. Hence, the life expectancy of the paper filter can be extended.

In addition, according to the other preferred embodiments of the present invention, since dirt of a relatively large particle size collected at the dirt collecting tub is not caught in the dirt separating grill to choke the holes of the dirt separating grill so as, it is possible to prevent the overload of the cyclone dust collecting device or the motor as well as to prevent the deterioration of the cleaning efficiency.

Although the preferred embodiments of the present invention have been described, it will be understood by those skilled in the art that the present invention should not be limited to the described preferred embodiments, but various changes and modifications can be made within the spirit and scope of the invention as defined by the appended claims.

What is claimed is:

1. A vacuum cleaner, comprising:

a main body of said vacuum cleaner;

an extension pipe connecting said main body with a suction opening for receiving dirt suctioned for passage into said extension pipe; and a cyclone dust collecting device positioned in a different axis with respect to said extension pipe so as to receive the dirt suctioned through said suction opening and through said extension pipe of said vacuum cleaner, said cyclone dust collecting device comprising:

a cyclone body having a first connecting tube connected to said extension pipe from a side of said extension pipe closer to said suction opening, a second connecting tube connected to said extension pipe from a side of said extension pipe closer to said main body, an air inlet formed at one side of said cyclone body to communicate with said first connecting tube, and an air outlet formed at an opposite side of said cyclone body to communicate with said second connecting tube, said cyclone body for producing a whirlpool air current for the dirt contained in air suctioned via said air inlet;

a dirt separating grill having a plurality of holes of a size for preventing the dirt of a predetermined particle size from flowing through said air outlet, said dirt separating grill being positioned within said cyclone dust collecting device so as to extend within said cyclone dust collecting device in a direction from said air outlet;

a dirt collecting tub for connection to said cyclone body, said dirt collecting tub for collecting the dirt separated from the air by the whirlpool air current of said cyclone body; and locking means for removably supporting said dirt collecting tub with respect to said cyclone body.

2. The vacuum cleaner as claimed in claim 1, further comprised of said cyclone body including a lower body unit having said first connecting tube and said air inlet, an upper body unit having said second connecting tube and said air outlet, and a plurality of screws for connecting said lower body unit to said upper body unit.

3. The vacuum cleaner as claimed in claim 2, further comprised of said locking means comprising:

a pair of suspension holes respectively formed in opposing relation in said lower body unit;

a pair of lockers each having a hook, said pair of lockers being respectively hinged to a pair of locker supporting units respectively positioned on said dirt collecting tub, each said hook for being hooked in a corresponding suspension hole of said pair of suspension holes; and a spring disposed between a corresponding locker of said pair of lockers and a corresponding locker supporting unit of said pair of locker supporting units, said spring for elastically supporting a corresponding said locker.

4. The vacuum cleaner as claimed in claim 1, further comprised of said dirt separating grill comprising a grill guide unit having a rib groove in which a curve rib for defining a boundary of said air outlet in said cyclone body is inserted, a conical grill unit having a hollow interior, and a cylindrical grill unit having a closed end opposite an end of said cylindrical grill unit that is adjacent to said conical grill unit, said plurality of holes of said size being formed in a portion of said dirt separating grill near said air inlet in said conical grill unit and in a circumferential surface of said cylindrical grill unit.

5. The vacuum cleaner as claimed in claim 1, further comprised of a dirt blocking means being disposed at one end of said dirt separating grill to block the dirt in the air in an air current in said dirt collecting tub before the dirt reaches said dirt separating grill.

6. The vacuum cleaner as claimed in claim 5, further comprised of said dirt blocking means comprising a dirt blocking plate adjacent to said one end of said dirt separating grill and a conical shaped portion adjacent to said dirt blocking plate, said conical shaped portion having a diameter at one end of said conical shaped portion which is greater than a diameter at an opposite end of said conical shaped portion that is adjacent to said dirt blocking plate.

7. The vacuum cleaner as claimed in claim 6, further comprised of a supplemental blocking member for supplementing the operation of said dirt blocking plate being positioned as an extension unit of said dirt blocking means at said one end of said conical shaped portion of said dirt blocking means.

8. The vacuum cleaner as claimed in claim 5, further comprised of said dirt blocking means comprising a conical dirt blocking rotation plate disposed at said one end of said dirt separating grill, said conical dirt blocking rotation plate being rotated by the whirlpool air current.

9. The vacuum cleaner as claimed in claim 8, further comprised of a supplemental blocking member for supplementing the operation of said conical dirt blocking rotation plate being positioned as an extension unit of said conical dirt blocking rotation plate.

10. The vacuum cleaner as claimed in claim 1, further comprised of a supporting unit for supporting said dirt collecting tub by said extension pipe, and a fixing ring having a slide groove into which said supporting unit is inserted, said fixing ring being disposed at said extension pipe of said vacuum cleaner.

11. The vacuum cleaner as claimed in claim 10, further comprised of said supporting unit including a fixing projection having a suspension jaw which is fixed by being inserted into said slide groove of said fixing ring, and including a guide projection which is formed adjacent to said fixing projection for guiding the insertion of said fixing projection into said slide groove.

12. The vacuum cleaner as claimed in claim 10, further comprised of said dirt collecting tub being formed in a cylindrical shape with a predetermined diameter.

13. The vacuum cleaner as claimed in claim 10, further comprised of said dirt collecting tub being formed in a cylindrical shape, said dirt collecting tub having a portion of a first diameter and another portion of a second diameter, said first diameter being smaller than said second diameter.

14. The vacuum cleaner as claimed in claim 10, further comprised of said dirt collecting tub comprising a first cylindrical unit having a predetermined diameter and a second cylindrical unit having a diameter greater than said predetermined diameter of said first cylindrical unit.

15. The vacuum cleaner as claimed in claim 14, further comprised of said second cylindrical unit being formed in a conical shape.

16. A vacuum cleaner, comprising:

a cyclone dust collecting device arranged to be disposed in a different axis with respect to an extension pipe connecting a main body of the vacuum cleaner and a suction opening for the vacuum cleaner, said cyclone dust collecting device for separating and collecting dust and dirt which are suctioned via said suction opening together with air by centrifugal force, said cyclone dust collecting device comprising:

a cyclone body having a first connecting tube and a second connecting tube for connection to said extension pipe of the vacuum cleaner, an air inlet formed at one side of said cyclone body to communicate with said first connecting tube and an air outlet formed at an opposite side of said cyclone body to communicate with said second connecting tube, said cyclone body for producing a whirlpool air current;

a dirt collecting tub for connection to said cyclone body, said dirt collecting tub for collecting the dirt separated from the air by the whirlpool air current of said cyclone body;

a dirt separating grill extending within said cyclone dust collecting device in a direction from said air outlet, said dirt separating grill having a plurality of holes of a size for preventing the dirt of a predetermined particle size from flowing with the air into said air outlet;

dirt blocking means disposed at one end of said dirt separating grill to block dirt in the air in an air current in said dirt collecting tub before the dirt reaches said dirt separating grill; and locking means for removably supporting said dirt collecting tub with respect to said cyclone body.

17. The vacuum cleaner as claimed in claim 16, further comprised of said cyclone body including a lower body unit having said first connecting tube and said air inlet, an upper body unit having said second connecting tube and said air outlet, and a plurality of screws for connecting said upper body unit to said lower body unit.

18. The vacuum cleaner as claimed in claim 17, further comprised of said locking means comprising:

a pair of suspension holes respectively formed in opposing relation in said lower body unit;

a pair of lockers each having a hook, said pair of lockers being respectively hinged to a pair of locker supporting units respectively positioned on said dirt collecting tub, each said hook for being hooked in a corresponding suspension hole of said pair of suspension holes; and a spring disposed between a corresponding locker of said pair of lockers and a corresponding locker supporting unit of said pair of locker supporting units, said spring for elastically supporting a corresponding said locker.

19. The vacuum cleaner as claimed in claim 16, further comprised of said dirt separating grill comprising a grill guide unit having a rib groove in which a curve rib for defining a boundary of said air outlet in said cyclone body is inserted, a conical grill unit having a hollow interior, and a cylindrical grill unit having a closed end opposite an end of said cylindrical grill unit that is adjacent to said conical grill unit, said plurality of holes of said size being formed in a portion of said dirt separating grill near said air inlet in said conical grill unit and in a circumferential surface of said cylindrical grill unit.

20. The vacuum cleaner as claimed in claim 16, further comprised of said dirt blocking means comprising a dirt blocking plate adjacent to said one end of said dirt separating grill and a conical shaped portion, said conical shaped portion having a diameter at one end of said conical shaped portion which is greater than a diameter at an opposite end of said conical shaped portion that is adjacent to said dirt blocking plate.

21. The vacuum cleaner as claimed in claim 16, further comprised of a supporting unit for supporting said dirt collecting tub by said extension pipe, and a fixing ring having a slide groove into which said supporting unit is inserted, said fixing ring being disposed at said extension pipe of the vacuum cleaner.

22. The vacuum cleaner as claimed in claim 21, further comprised of said supporting unit including a fixing projection having a suspension jaw which is fixed by being inserted into said slide groove of said fixing ring, and including a guide projection which is formed adjacent to said fixing projection for guiding the insertion of said fixing projection into said slide groove.

* * * * *